US007038390B2

(12) United States Patent
Swami et al.

(10) Patent No.: US 7,038,390 B2
(45) Date of Patent: May 2, 2006

(54) LAMP CONTROL SYSTEM

(75) Inventors: Shirish Swami, Slough (GB); Neil Kapoor, Hayes (GB); Jason Newell, Ealing (GB)

(73) Assignee: Nordson Corporation, Westlake, OH (US)

( * ) Notice: Subject to any disclaimer, the term of this patent is extended or adjusted under 35 U.S.C. 154(b) by 40 days.

(21) Appl. No.: 10/406,018

(22) Filed: Apr. 3, 2003

(65) Prior Publication Data

US 2004/0021428 A1 Feb. 5, 2004

(30) Foreign Application Priority Data

Apr. 8, 2002 (GB) ..... 0208049.7

(51) Int. Cl.
*H01J 13/32* (2006.01)
*B41F 35/00* (2006.01)

(52) U.S. Cl. ..... 315/112; 315/117; 315/118; 101/424.1; 101/487

(58) Field of Classification Search ..... 347/102, 347/101, 18; 315/240, 241, 115–118, 149, 315/150–159, 104–108, 112, 307, 309, 291, 315/DIG. 4; 313/13, 11; 101/424.1, 487–489
See application file for complete search history.

(56) References Cited

U.S. PATENT DOCUMENTS

| | | | | |
|---|---|---|---|---|
| 4,032,817 | A * | 6/1977 | Richmond | 315/149 |
| 4,518,895 | A * | 5/1985 | Lehman | 315/117 |
| 4,533,854 | A * | 8/1985 | Northrup | 315/117 |
| 4,873,470 | A * | 10/1989 | Myers | 315/240 |
| 5,585,832 | A * | 12/1996 | Orimoto et al. | 347/175 |
| 6,078,148 | A * | 6/2000 | Hochstein | 315/291 |
| 6,244,700 | B1 * | 6/2001 | Kimura et al. | 347/102 |
| 6,759,793 | B1 * | 7/2004 | Narita | 313/13 |

FOREIGN PATENT DOCUMENTS

| | | |
|---|---|---|
| EP | 1054581 | 11/2000 |
| EP | 1178510 | 2/2002 |
| GB | 2319406 | 5/1998 |
| GB | 2336895 | 11/1999 |

* cited by examiner

*Primary Examiner*—Tuyet Thi Vo
(74) *Attorney, Agent, or Firm*—Wood, Herron & Evans, L.L.P.

(57) ABSTRACT

A method and apparatus are provided for reducing the stable lamp standby power to the order of 5% of nominal full power in order to reduce the effects of heat from the lamp on a substrate during production downtime. In particular, a power controller changes the operating voltage and current of the lamp, and controls the temperature of the lamp in order to maintain stable lamp operation at the changed voltage and current.

15 Claims, 4 Drawing Sheets

LAMP CONTROL SYSTEM

FIELD OF THE INVENTION

The present invention relates to controlling the power output from lamps such as arc lamps for example.

BACKGROUND OF THE INVENTION

Mercury arc lamps have a number of applications in industry such as ultraviolet lamps for drying ink in printing applications. Industrial applications often require that the output from the lamp be controlled.

An example of such an application is illustrated schematically in FIG. 1, which represents an ultraviolet curing system for a printing application. After applying UV inks or coatings (2), a substrate (1) passes under an ultraviolet lamp (3) causing the monomers within the ink or coating to cross-link and cure. On certain applications the substrate will stop underneath the ultraviolet lamp (3) which is controlled to switch down to 20–30% of its nominal power. However, on recently developed heat-sensitive substrates (1) this level of power can still be sufficient to cause the material (1) to melt or burn.

The power output of a lamp is typically controlled by switching capacitors into and out of the lamp circuit as described, for example, in U.S. Pat. No. 4,873,470. The practical limits of this arrangement are about 20% of normal full power. Any further reduction in lamp power results in the lamp's operation becoming unstable, for example the lamp flickers, which is undesirable for both the curing operation to which the lamp is applied and the lamp life.

SUMMARY OF THE INVENTION

The present invention aims to provide a control system by which an arc lamp may stably operate at very low power, for example less than 20% of nominal power, and preferably between 3% and 7% of nominal power. The present invention also aims to provide an alternative method of controlling the lamp power output.

By externally influencing the temperature of the lamp, the voltage and current at which the lamp will stably operate can be modified. In this way, the percentage of nominal power at which the lamp will stably operate can be reduced by externally controlling the operating temperature of the lamp. Preferably, this is achieved by passing an airflow across the lamp to maintain the lamp within predetermined temperature limits.

The present invention is especially applicable to drying in printing applications utilizing a UV mercury arc lamp. These can typically stably operate between 20–100% of nominal power. This means that should the printing apparatus need to stop production for a period then the lamp can be switched down to standby power (e.g., 0.0%) in order to reduce the heat build up to the apparatus and material (substrate and printing ink) adjacent the lamp. However 20% standby power is still quite appreciable, especially for certain types of substrates, and can damage these requiring further interruptions to production. The invention provides for lower standby power (e.g., 5%) while still maintaining stable operation of the lamp such that it can quickly be brought up to full or high power again for normal operation of the printer.

The present invention also provides a system and method of rapidly changing from full power to low or standby power, by switching the lamp off for a predetermined period and thereby allowing the lamp to cool. The lamp is re-ignited at the lower temperature with lower voltage and/or current, and the lamp is maintained at this lower temperature. Preferably, the step of allowing the lamp to cool further comprises passing an airflow over the lamp.

BRIEF DESCRIPTION OF THE DRAWINGS

The present invention is described in detail with reference to the following drawings, by way of example only and without intending to be limiting, in which.

DETAILED DESCRIPTION

Figure 1:
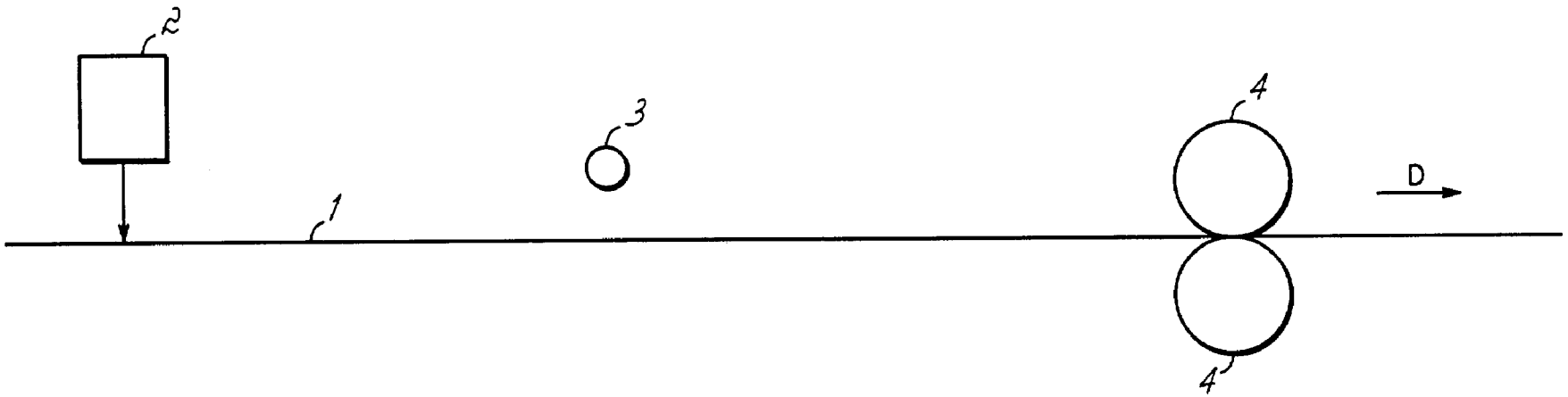
FIG. 1 is a schematic diagram of a printing application using an ultraviolet lamp.

FIG. 1 shows a known printing application using an ultraviolet mercury arc lamp (3) in which a substrate (1) is moved in the direction indicated D first under a printing apparatus (2), then the ultraviolet lamp (3). Printing ink is applied to the substrate by the printing apparatus (2), the substrate and ink are then exposed to the ultraviolet radiation of the lamp (3) which cures the ink. On occasion, for example if there is a problem with the substrate feeder (4), the substrate is stopped such that part of the substrate is exposed to the ultraviolet lamp (3) for the period during which production has stopped. Typically, the lamp is reduced to what is known as a "standby" power level (typically 20–30%). However, even this low power level can be damaging to certain types of substrates.

Mercury arc lamps initially require a high current through the lamp to heat up the liquid mercury via gas excitation, this is known as striking. As the mercury vaporizes, known as burning-in, the impedance of the lamp increases such that the voltage increases and the current reduces. The voltage and current stabilize when all the mercury has vaporized, and the lamp is said to have been burned in. The lamp power can be reduced by lowering the current of the lamp which may result in some mercury liquefying especially at very low currents, however the lamp remains running stably. The practical limit for standby power is about 20%, any lower and the lamp is likely to extinguish. By running the lamp in standby power, the lamp can quickly be brought back up to full power without the need to switch the lamp off when production is halted, then wait while it is started again (strike and burning-in stages). This can save considerable production down-time, but as explained above can result in some substrates being damaged while left stationary adjacent the lamp at standby power.

Figure 2:
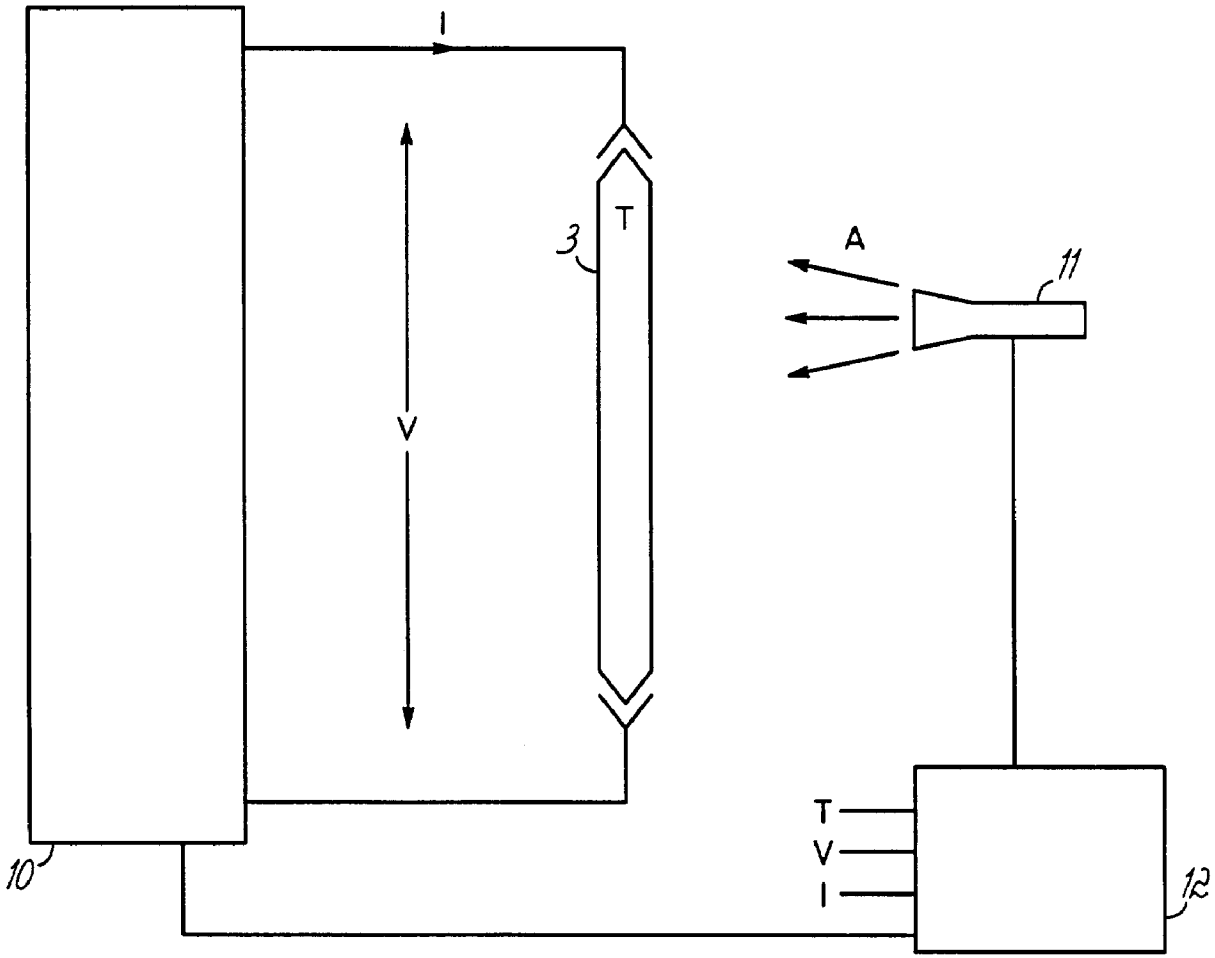
FIG. 2 shows a control system according to the present invention.

Referring now to FIG. 2, an embodiment of the invention is there shown and comprises a power supply (10) coupled to the lamp (3), an airflow generator (11) which is controlled by an airflow controller (12). The airflow generator (11) is arranged to pass an airflow (A) across the lamp (3) which has the effect of changing the temperature of the lamp. The airflow controller (12) controls operation of the airflow generator (11) by either toggling the generator (11) on and off, or by reducing or increasing the airflow (A). The power supply (10) is arranged to control the voltage (V) and current (I) supplied to the lamp (3). The temperature of the lamp (3) is indicated by (T) in FIG. 2.

When the airflow generator (11) is operational, the airflow (A) passing over the lamp (3) reduces the temperature (T) of the lamp, and stopping or reducing the airflow allows the temperature of the lamp to rise. Maintaining the lamp temperature within predetermined limits allows the lamp to operate at much lower power (VI) levels than would otherwise be possible. For example, the lamp power can be reduced to as low as 3% of nominal power while still maintaining operation (i.e., the mercury arc is still present and the lamp doesn't have to be restarted). In order to avoid damaging any currently available substrates (1), the lamp (3) is preferably operated between 5% and 7% of nominal power in standby mode. In order to achieve this, the airflow generator (11) may either be toggled on and off by the airflow controller (12), or the level of airflow A increased or decreased to maintain the required lamp temperature T.

In order to switch between full lamp power and standby power, the lamp is switched off either by significantly reducing its temperature (T) using the airflow (A), and/or by switching off the power (VI) to the lamp (3). Once the lamp temperature (T) has reduced to a predetermined range, then the lamp is allowed to re-ignite at a lower power rating (VI). The controller (12) maintains the lamp (3) at this lower temperature range in order to maintain steady state illumination of the lamp (3) at reduced power.

In a preferred arrangement of the embodiment, the lamp is an ultraviolet lamp of the mercury arc lamp type, for example a 79 cm arc lamp head with a nominal power of 200 W/cm (15800 W). At full power the lamp operates at 1350 volts and 13 amps. At 30% power, the lamp operates at 1150 volts and 4.5 amps. Using the embodiment, the lamp can be made to run stably at 5% of power at 600 volts and 1.35 amps by maintaining the lamp temperature at around 450° C.

The temperature of the lamp (3) can be determined in a number of ways, including, for example, directly via a thermocouple in the proximity of the lamp (3). In the lab various airflow configurations and values are tested to determine the optimum airflow figures to maintain the lamp within predetermined temperature ranges. These airflow figures are then used for commissioning the lamp under on-site conditions The power supply (10) is either a digital power supply (DPS) or a traditional transformer system. The DPS system has the facility for controlling the current (I) flowing in the lamp (3) and the voltage (V) applied across it. The transformer system controls only the power input for a given system configuration. The embodiment has a number of advantages over prior art arrangements when applied to the printing application of FIG. 1, including lack of damage to substrates (1) that stop underneath the UV lamp (3), reduced energy consumption (5% instead of 30%), reduced risk of fire, and reduced build up of heat within the press. The embodiment, when used with the DPS, also allows the use of multiple fractions of the nominal power of the lamp for different applications from approximately 15% to 100% of nominal lamp power. The embodiment also provides a method of rapidly switching between nominal or full power and low power settings, which is particularly important in a production setting where interruptions to production should be kept to a minimum. By applying an airflow (A) to the lamp (3), the lamp is rapidly cooled and can then be allowed to re-ignite at the lower power setting.

Figure 3:
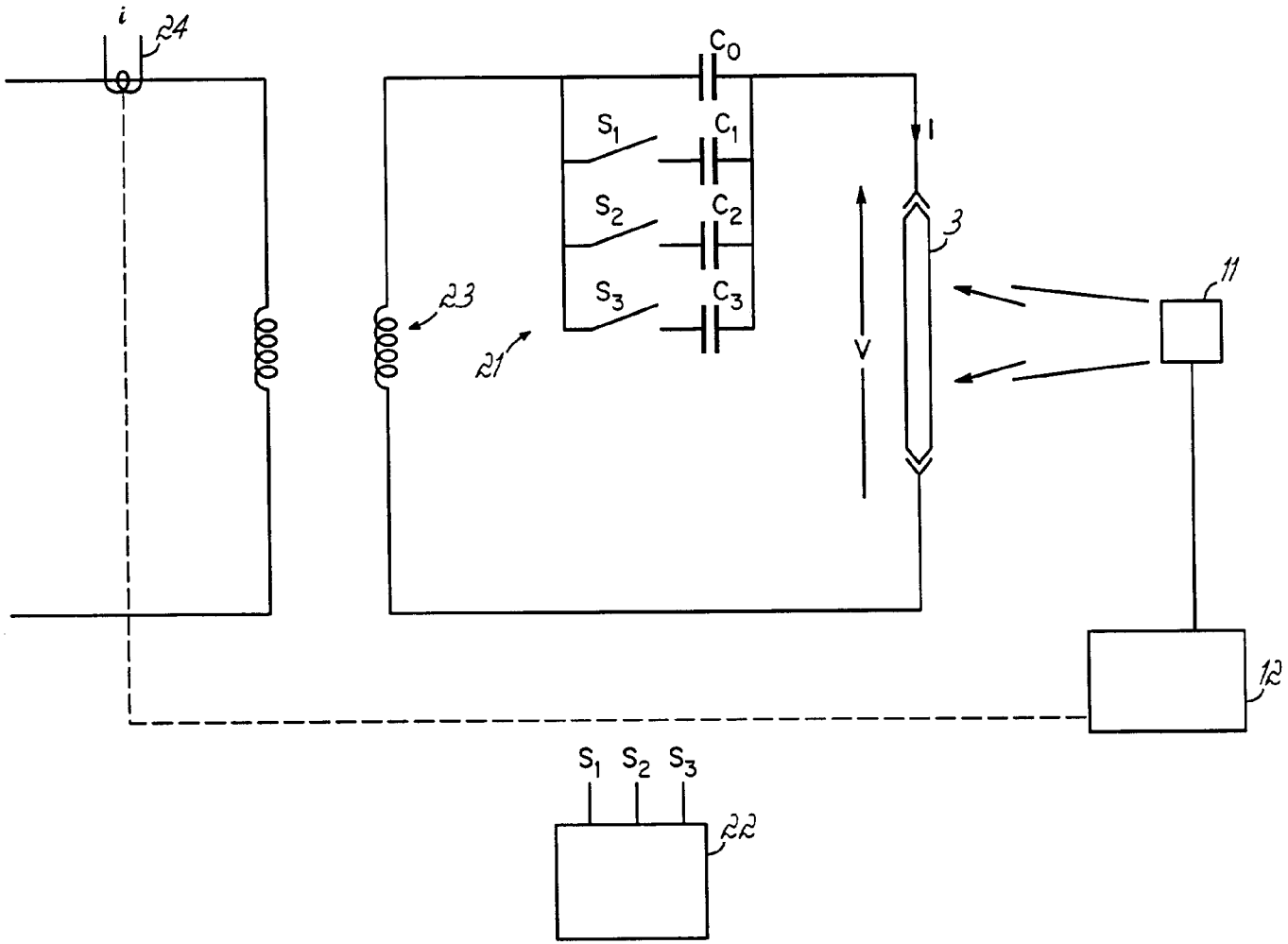
FIG. 3 is a schematic of one embodiment of the power supply of the system of FIG. 2.

FIG. 3 shows a second embodiment of the present invention which utilizes a transformer based power supply. The embodiment comprises a lamp (3), airflow generator (11), and airflow controller (12) as before, the power supply (10 in FIG. 2) comprises a three-phase transformer (23), two of the secondary phases being coupled across the lamp (3). Also coupled across the lamp (3) is a capacitor ($C_0$) and a bank of switchable capacitors (21). The capacitor bank (21) comprises a number of capacitors ($C_1$–$C_3$) together with associated switches ($S_1$–$S_3$). The switches (S) are in turn controlled by a switching controller (22) which is arranged to switch the various capacitors ($C_1$–$C_3$) into and out of the secondary circuit of the transformer (23). As is well-known, this has the effect of varying the power supply to the lamp (3) such that fractions of the nominal or full operating lamp power can be achieved. In prior art arrangements, the practical minimum fractional power is typically 20% of nominal lamp power. In the present embodiment, however, by reducing the temperature of the lamp (3) using the airflow generator (11), the lamp (3) can be made to operate stably at even lower fractional powers, for example 5%.

In order to maintain the lamp (3) within the predetermined temperature range, the embodiment uses current sensors (24) on the primary circuit (23) which have a known correspondence with the current (I) through the lamp (3). From this value the air generator (11) is actuated to a predetermined value in order to maintain the lamp temperature and stability.

Figure 4:
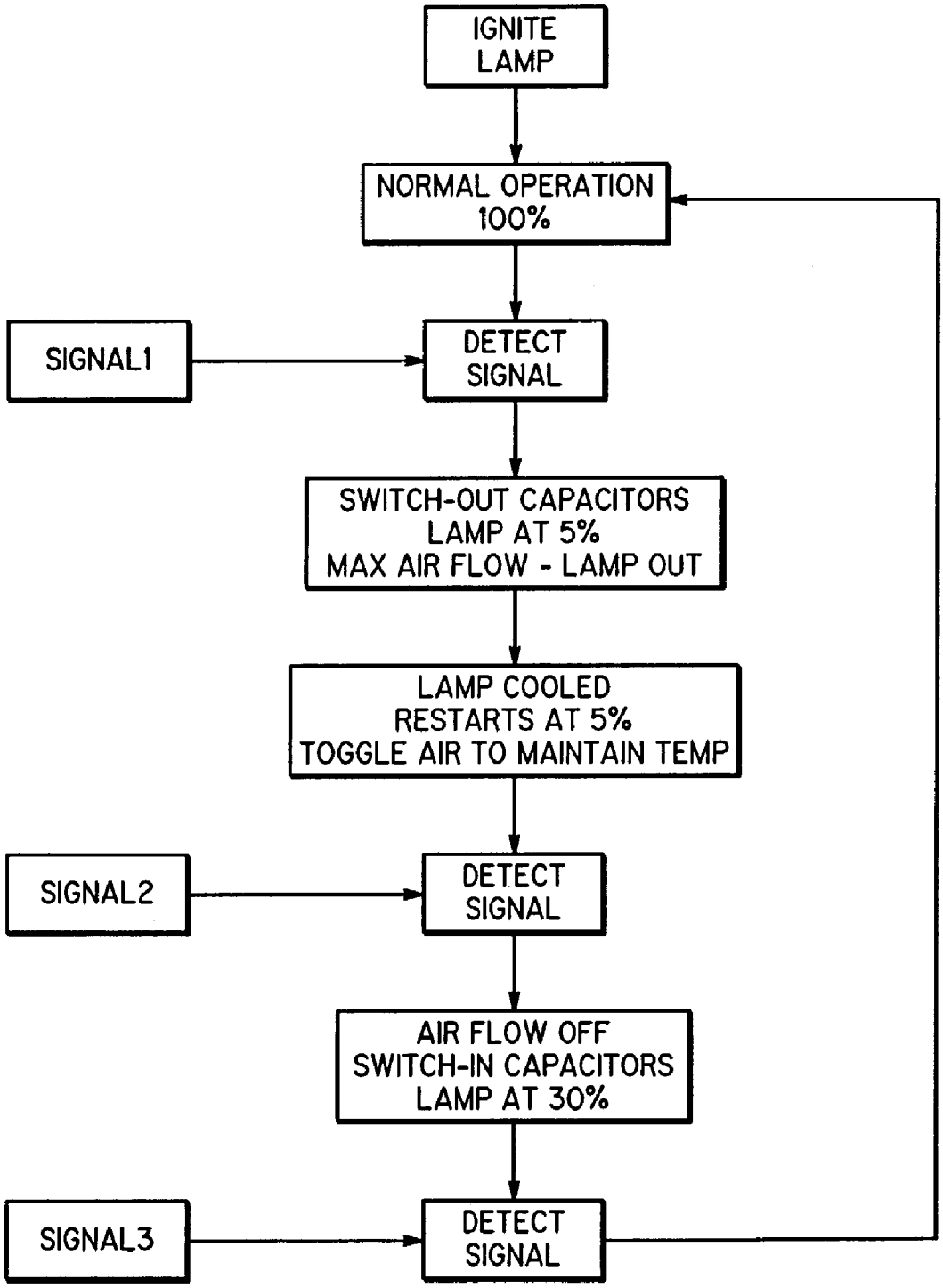
FIG. 4 is a flow chart of the control of a lamp in a printing application.

Referring to FIG. 4, a preferred method of operating the lamp in a printing application is described. Following ignition of the lamp using a high voltage in the known manner, when the lamp is fully burned in, it will run in its normal steady state mode at 100% nominal power. Signal 1 indicates that the substrate (1) of FIG. 1 has stopped moving in direction (D) and that the power of the UV lamp should be reduced to 5% in order to remain benign against the proximate substrate (1). This will occur if, for example, there is a problem with the substrate feeder or a problem with the substrate mechanism.

Upon detection of Signal 1, all of the capacitors $C_1$–$C_3$ of the capacitor bank (21) are switched out of circuit in order to reduce the lamp power to 5%. The airflow generator (11) is also set to maximum airflow (A) which rapidly cools the lamp (3) and, as a consequence, switches it off. Once the lamp has cooled to within a predetermined range of temperatures, the airflow generator (11) is reset to an intermediate airflow setting and toggled on and off by the controller (12) in order to maintain the lamp within the predetermined temperature range. The lamp automatically reignites at the lower (5%) power (this is a characteristic of this system) and runs stably at this power level with the airflow generator (11) maintaining the lamp (3) within the predetermined temperature range.

Signal 2 indicates a drying phase of printing ink on the substrate (1) and is coupled to movement of the substrate such that the newly printed area is now proximate the UV lamp (3). Upon detecting Signal 2, airflow generator (11) is switched off, and some of the capacitors ($C_1$–$C_3$) of the capacitor bank (21) are switched in the circuit which increases the power consumed by the lamp (3) to 30% of its nominal power. In FIG. 3, switch ($S_3$) is shown closed and thereby switches in capacitor $C_3$. Signal 3 corresponds to the printed area having been dried and the substrate (1) being moved in direction (D). Upon detection of Signal 3, all of the capacitors ($C_1$–$C_3$) of the switch bank (21) are switched in circuit which brings the lamp (3) back up to full or 100% nominal power. This corresponds to the substrate (1) being moved under the lamp (3) in the direction (D).

Preferably the printing apparatus of FIG. 1 and the airflow controller (12) and capacitor bank controller (22) are in turn controlled by a PLC system.

By controlling the switches ($S_1$–$S_3$) in the capacitor bank (21), and in tandem controlling the airflow A over the lamp (3), it is possible to stably maintain a large number of possible power levels appropriate for different applications. For example, different power levels may be appropriate for different printing inks and/or substrate materials. By applying an airflow (A) across the lamp (3) the heat from the lamp (3) can be reduced very quickly, thereby avoiding the effects on the substrate that a residually hot lamp (even when switched off) might cause, such as crinkling the substrate which can damage subsequent printing apparatus. The use of more appropriate power levels also reduces power consumption which can be significant in a large plant, and has the additional benefit of not requiring the same heat dissipation measures necessary for prior art arrangements in which an necessarily hot lamp heats up surrounding plant.

While it is preferred to apply cool air (A) to switch the lamp off and allow to cool before re-igniting at the lower power, it is possible to simply switch the power off and allow the lamp to cool naturally before reapplying the lower power. As an alternative to measuring the current (primary or secondary), the voltage across the lamp may be measured.

The invention has been described with reference to preferred embodiments thereof. Alterations and modifications as would be obvious to those skilled in the art are intended to be incorporated within the scope hereof.

The invention claimed is:

1. A power controller for an arc lamp, comprising:

a first control device configured to regulate electrical power supplied to the arc lamp, wherein said first control device comprises a transformer and plurality of capacitors adapted to be coupled to the arc lamp, and wherein at least some of said capacitors are adapted to be coupled to the arc lamp by switches operable to vary the electrical power provided to the arc lamp;

a sensor for determining a temperature of the arc lamp and generating an output representative of the temperature; and a second control device coupled with said first control device and responsive to said sensor output for regulating the temperature of the arc lamp such that the temperature of the arc lamp is maintained within a range dependent on the power supplied to the arc lamp as regulated by said first control device.

2. The power controller of claim 1, wherein the arc lamp has a nominal operating power, and wherein said first and second control devices cooperate to operate the lamp within 3 percent to 7 percent of the nominal operating power.

3. The power controller of claim 1, wherein said first control device is configured to regulate at least one of a current and a voltage provided to the arc lamp.

4. The power controller of claim 1, wherein said second control device comprises an airflow generator configured to direct a flow of air across the arc lamp.

5. The power controller of claim 1, wherein said sensor is configured to sense at least one of a current and a voltage provided to the arc lamp.

6. The power controller of claim 1, further comprising an airflow controller in communication with said sensor and said second control device, wherein said airflow controller is configured to receive said sensor output and vary operation of said second control device according to said sensor output.

7. The power controller of claim 6, wherein said airflow controller is further configured to vary operation of said second control device according to a signal indicative of at least one of a substrate position and substrate movement.

8. A lamp system comprising:

an arc lamp;

a first control device coupled with the arc lamp and configured to regulate electrical power supplied to the arc lamp, wherein said first control device comprises a transformer and plurality of capacitors adapted to be coupled to the arc lamp, and wherein at least some of said capacitors are adapted to be coupled to the arc lamp by switches operable to vary the power provided to the arc lamp;

a sensor for determining a temperature of the arc lamp and generating an output representative of the temperature; and a second control device coupled with said first control device and responsive to said sensor output for regulating the temperature of the arc lamp such that the temperature of the arc lamp is maintained within a range dependent on the power supplied to the arc lamp as regulated by said first control device.

9. The lamp system of claim 8, wherein said first control device is configured to regulate at least one of a current and a voltage provided to the arc lamp.

10. The lamp system of claim 8, wherein said second control device comprises an airflow generator configured to direct a flow of air across the arc lamp.

11. A method of controlling an arc lamp, comprising:

using a sensor for determining a temperature of the arc lamp to generate an output;

varying the temperature of the arc lamp according to said sensor output to maintain the lamp temperature within a temperature range based on the sensed electrical power provided to the arc lamp;

moving a substrate adjacent the arc lamp;

operating the arc lamp;

stopping the movement of the substrate;

reducing the electrical power provided to the arc lamp to 3 percent to 7 percent of its nominal power when the substrate stops moving;

cooling the arc lamp with a flow of air; and varying the flow of air when the substrate begins to move.

12. The method of claim 11, wherein varying the temperature of the arc lamp further comprises:

varying a flow of air directed over the arc lamp.

13. The method of claim 11, wherein sensing the electrical power provided to the arc lamp further comprises:

sensing electrical current provided to the arc lamp.

14. The method of claim 11, further comprising:

controlling the electrical power supplied to the arc lamp such that the arc lamp is operating at between 3 percent and 7 percent of its nominal power.

15. The method of claim 11, further comprising:

increasing the electrical power provided to the arc lamp when the substrate begins to move.

* * * * *